United States Patent [19]

Iyama et al.

[11] 4,353,530

[45] Oct. 12, 1982

[54] METHOD AND APPARATUS FOR AUTOMATICALLY PUNCHING THE TUYERES OF A CONVERTER

[75] Inventors: Yukio Iyama; Masao Fujita; Nobuhiro Higashiiriki, all of Saganoseki, Japan

[73] Assignee: Nippon Mining Company Limited, Tokyo, Japan

[21] Appl. No.: 169,690

[22] Filed: Jul. 17, 1980

[30] Foreign Application Priority Data

Jul. 23, 1979 [JP] Japan ..... 54-92665

[51] Int. Cl.[3] ..... F27B 7/20; C21C 5/46

[52] U.S. Cl. ..... 266/45; 266/135; 266/269; 266/271

[58] Field of Search ..... 266/45, 47, 135, 136, 266/269, 271-273, 287

[56] References Cited

U.S. PATENT DOCUMENTS 4,202,536 5/1980 Demidowicz et al. ..... 266/271

FOREIGN PATENT DOCUMENTS 46-6684 2/1971 Japan ..... 266/269

*Primary Examiner*—Peter K. Skiff

*Attorney, Agent, or Firm*—Sughrue, Mion, Zinn, Macpeak & Seas

[57] ABSTRACT

Method and apparatus for punching the tuyeres of a converter with a mechanical puncher mounted upon a carriage running on rails. Light intercepting plates encoded by light transmission holes are disposed opposite each tuyere. Light is shone towards the light intercepting plates and detected on the opposite side thereof by photoelectric elements the outputs of which are coupled to a digital processor which controls the speed and position of the carriage. The mechanical puncher has two cylinders each of which drives two punching rods to successively punch the tuyeres. If it is impossible to punch a tuyere with the mechanical puncher were moving in one direction, the position of the puncher is shifted by one tuyere to start the punching again in the opposite direction.

5 Claims, 11 Drawing Figures

METHOD AND APPARATUS FOR AUTOMATICALLY PUNCHING THE TUYERES OF A CONVERTER

BACKGROUND OF THE INVENTION

The invention relates to a method for automatically punching the tuyeres of a converter.

Converters are extensively employed for smelting metals. In smelting copper with a converter, air is blown into a matte containing 40% to 60% copper, and the remaining contents, iron and sulfur, are removed by converting them into iron oxides and sulfur dioxide so as to obtain blister copper containing about 98% copper. The air blowing nozzles are relatively small in diameter, typically several tens of millimeters. Molten materials in the converter is solidified and form encrustations at inner tips of the tuyeres by adiabatically cooling the molten materials with blowing air. In this case, it becomes difficult to supply sufficient amount of air into the converters, as a result of which the converting operation must be suspended, when the solidified encrustations has been grown up. Therefore, mechanical punching operation is carried out in order to remove the solidified encrustations frequently.

Heretofore, an operator seated on an operator's seat on the carriage of a mechanical puncher having punching rods coupled to a fluid-driven cylinder visually confirmed the positions of the tuyeres of a converter and controlled the running and stopping of the carriage to achieve a punching operation to clear the nozzles. Accordingly, the punching operation could not be accomplished without considerable operator skill. Furthermore, with a mechanical puncher having four punching rods driven by a single cylinder in order to reduce the time required for punching operation, much higher skill is required for the operator to accurately position the carriage correctly with respect to the intended tuyeres. The working environmental conditions around the converter are poor because of the presence of noise, heat, dust, etc. In addition, there is the danger that the converter may "foam", that is jet out high-temperature molten materials. The provision of a method for automatically and positively punching the tuyeres and an apparatus for practicing the method has been strongly demanded in the art.

Accordingly, an object of this invention is to provide a method for automatically, positively and safely punching the tuyeres of a converter.

SUMMARY OF THE INVENTION

In accordance with this object, a specific advantageous feature of the invention resides in that an AC variable speed motor with a brake is employed to run a mechanical puncher carriage on the rails so that the carriage is run and stopped quickly and positively. A non-contacting type position detecting device having detectable elements and a control device for processing signals outputted by the position detecting device are used to quickly and positively detect the positions of the tuyeres and to automatically punch the tuyeres.

Another specific advantageous feature of the invention resides in the travel of the carriage which mounts mechanical puncher. That is, according to the present invention, since a pair of punching rods are simultaneously driven by a single cylinder, if hard or rigid encrustation is formed in one of the tuyeres, the neighbouring tuyere can not be subject to punching during travel of the carriage in one direction along the converter. In this case however, during opposite travelling of the carriage, the carriage is initially shifted by one tuyere to start the punching operation, so that said unpunched tuyere can be punched. The tuyere formed with rigid encrustation can be punched manually or other suitable mechanical means so that all of the tuyeres are punched. Also, before the tuyeres are punched, the position or posture of the mechanical puncher is adjusted in conformance with the displacement of the tuyeres which are changed according to operational requirements of the converter.

DESCRIPTION OF THE PREFERRED EMBODIMENTS

The invention will be described with reference to the accompanying drawings.

Figure 1:
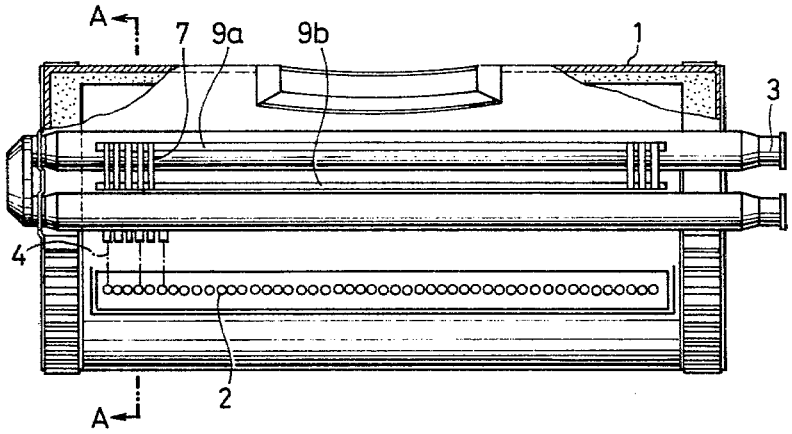
FIG. 1 is a front view of a converter showing light intercepting plates according to the invention.
Figure 2:
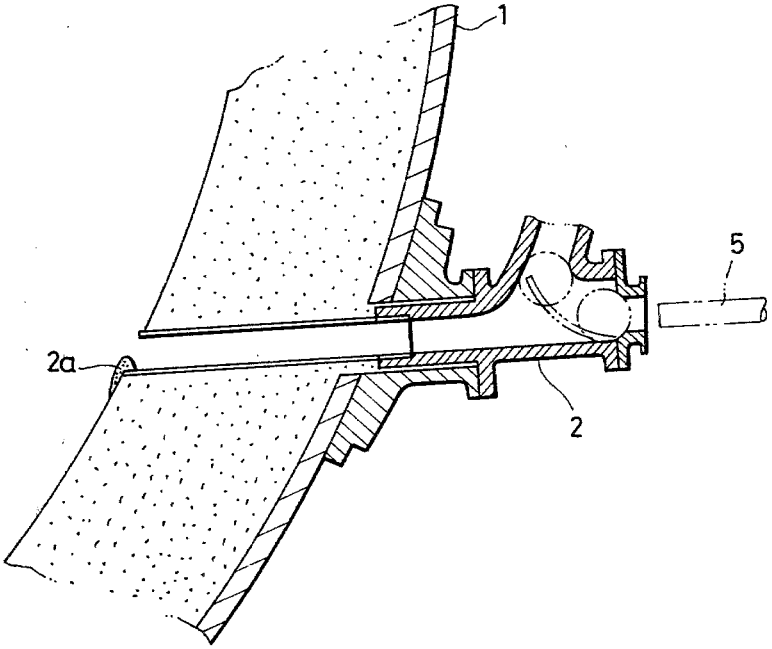
FIG. 2 is a sectional view of a tuyere showing solidified encrustations formed therein.

FIG. 1 is a side view, partly in longitudinal section, of a converter 1. Compressed air is supplied to tuyeres 2 through corresponding flexible tubes 4 coupled to the nozzles of a header 3. FIG. 2 is a sectional view of an essential part of the tuyere 2. When solidified encrustations 2*a* are formed in the tuyere 2, they can be removed by inserting a punching rod 5 into the converter 1 through the tuyere 2 through a closing mechanism of the tuyere, here simply a ball in the open position.

Figure 3:
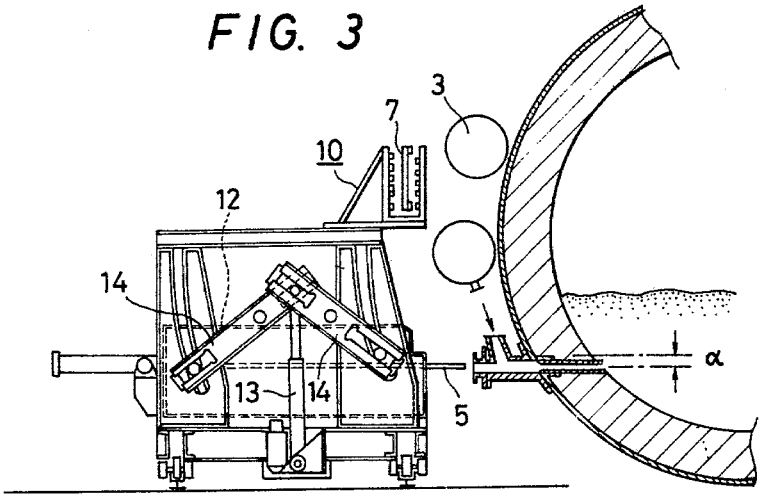
FIG. 3 is an explanatory diagram showing the positional relationships between the converter shown in section taken along a line A—A in FIG. 1 and a mechanical puncher on its carriage.

FIG. 3 shows a section taken along line A—A in FIG. 1 and the positional relationship of a mechanical puncher 12 constructed according to the invention. The mechanical puncher 12 is so designed that it may be tilted and displaced vertically and horizontally by means of a link drive device 13 and turning arms 14.

The invention will be described with reference to the case where the element to be detected is a light intercepting plate and the non-contacting type detector used is a photoelectric tube device. However, it should be noted that the invention is not limited thereto or thereby. That is, a detecting iron piece may be employed as the element to be detected and a contactless switch may be employed as the non-contacting type detector.

A number of light intercepting plates 7 as shown in FIG. 1 are provided which are equal to the number of tuyeres, as shown, 48 of each. The upper and lower end portions of each light intercepting plate 7, provided at a position corresponding to the respective tuyeres, are held by belt-shaped plates 9*a* and 9*b*, respectively, which are fixedly secured to posts (not shown) provided in the vicinity of the ends of the converter.

Figure 4:
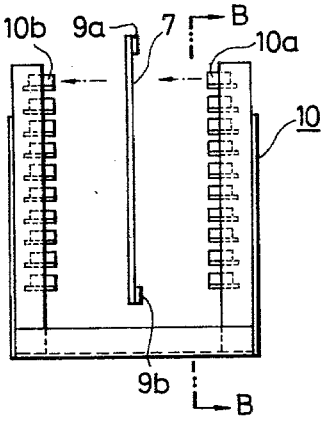
FIG. 4 is a side view showing the arrangement of a photoelectric tube device and the light intercepting plate.
Figure 5:
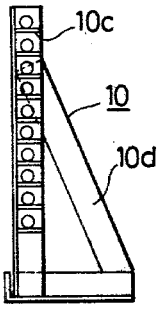
FIG. 5 is a sectional view taken along a line B—B in FIG. 4.

FIG. 4 is a front view showing the arrangement of a photoelectric tube device 10 and light intercepting plate 7 used with the invention. FIG. 5 is a sectional view taken along line B—B in FIG. 4.

Light emitting units 10*a* and light receiving units 10*b* are provided on both sides of the plate 7 in such a manner that the light emitting units 10*a* accurately confront the corresponding light receiving unit through the plate 7. The light emitting units produce non-diffused light beams. The light receiving units are preferably photoelectric tubes. The light emitting units 10*a* and the light receiving units 10*b* are fixedly mounted on the mounting plates 10*c* of a frame 10*d* in such a manner that the units 10*a* are positioned along a single vertical line and are arranged at equal intervals, and the units 10*b* are similarly positioned along a single vertical line at equal intervals.

Figure 6:
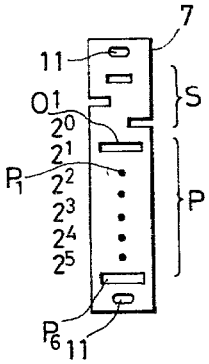
FIG. 6 is a front view of the light intercepting plate.

The light intercepting plate 7 provided as a thin metal plate 150 mm in width and 520 mm in length, for instance. The plate 7, as shown in FIG. 6, has a group S of spaced holes in the form of rectangular slits and cuts, a group P of position holes formed as a plurality of rectangular slits which are used to determine the position of the corresponding tuyere and mounting holes 11. The light emitting units 10*a* and the light receiving units 10*b* are arranged on common axes and the axes of the units are the same level as horizontal lines passing the centers of the rectangular slits.

A preferred method for punching the tuyeres of a converter according to the invention will now be described.

The converter is rotated according to operational requirements and accordingly the level of the line of tuyeres is displaced. Prior to the tuyere punching operation, the position of the mechanical puncher is changed by operating the link drive device according to the displacement of the tuyeres. As a result, the central axis of the punching rod of the mechanical puncher is brought into coincidence with the central axis of a tuyeres no matter what the operational requirements of the converter whereby the punching of the tuyeres can be achieved smoothly.

First, the case where the tuyeres are selectively punched will be described. A tuyere to be punched is set in a control device (not shown). Upon instruction of the start of operation, the carriage of the mechanical puncher is run with its run drive motor (not shown). While the carriage is being run, the numbers of the tuyeres are successively detected. When the tuyere of a number smaller by one than the number of the desired tuyere is detected, the speed of the carriage is automatically reduced. Then, the light receiving unit, the uppermost unit, detects the timing light transmission hole $t_1$ of the light intercepting plate corresponding to the desired tuyere whereupon the carriage is braked to a stop. This operation will be referred to as "step $t_1$" hereinafter. The run drive motor is preferably an AC variable speed motor with a brake the speed of which can be readily controlled.

If the carriage has run beyond the center of the desired tuyere, the over-run is detected by the light receiving unit corresponding to the light transmission cut $t_2$. The control device provides an instruction signal to return the carriage to the center of the desired tuyere. This operation will be referred to as "step $t_2$" hereinafter.

If in the return the carriage is moved too far, the fact of excessive return is detected by the light receiving unit corresponding to the light transmission cut $t_3$ and the control device outputs an instruction signal to return the carriage to the center of the desired tuyere. This operation will be referred to as "step $t_3$" hereinafter.

Usually, the carriage positioning operation is achieved in step $t_1$ or in step $t_2$ and the carriage stopped at the intended correct position. That is, in practice, step $t_3$ is most often unnecessary.

Once the carriage has been accurately positioned, the number of the desired tuyere is confirmed by a combination of the group of position holes or light transmission slits $P_1$ through $P_6$ and an instruction is applied to the mechanical puncher to start the punching of the desired tuyere.

A parity light transmission slit 0 is used as an error detecting hole. The slits in the group P correspond to $2^0$, $2^1$, $2^2$, $2^3$, $2^4$ and $2^5$ respectively beginning with the uppermost slit. That is, the slits represent numbers 1, 2, 4, 8, 16 and 32, respectively. For example, a light intercepting plate 7 having the slits $2^0$ and $2^1$ is provided for No. 3 ($2^0+2^1=3$) tuyere. Similarly, a light intercepting plate 7 having the slits $2^1$ and $2^3$ is provided for No. 10 tuyere and a light intercepting plate 7 having the slits $2^0$, $2^1$ and $2^3$ is provided for No. 11 tuyere. Upon completion of the punching of the desired tuyere, the carriage is moved to the next desired tuyere.

Figure 8:
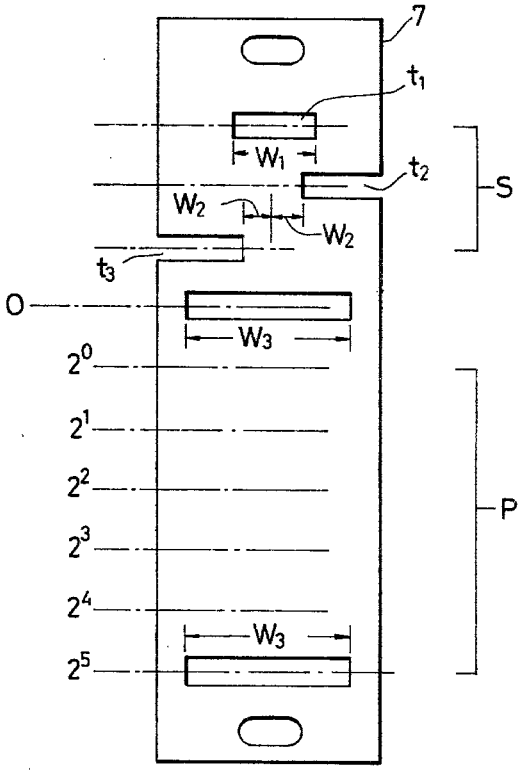
FIG. 8 is a front view showing light transmission holes formed in the light intercepting plate.

The dimensions of the light transmission holes in the example given here are $w_1=50$ mm, $w_2=15$ mm and $w_3=110$ mm as shown in FIG. 8 so that the carriage can be stopped with an error of $\pm 15$ mm with respect to the center of an aimed tuyere. Thus, the carriage can be automatically stopped at a position suitable for punching a tuyere. However, it should be noted that the dimensions of the light transmission holes are not limited to these particular values.

Figure 7:
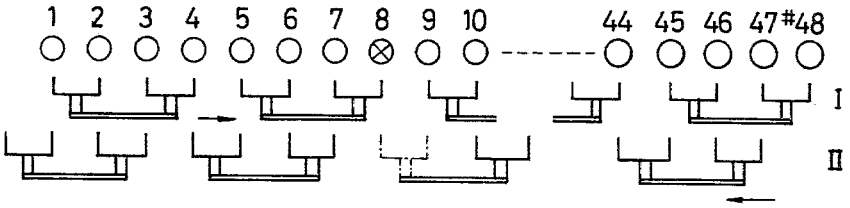
FIG. 7 is an explanatory diagram showing the positional relationships between the tuyeres and punching rods aligned with one another when the tuyeres are sequentially punched by the punching rods.

Next, the case where the forty-eight tuyeres shown in FIG. 1 are successively and continuously punched will be described. FIG. 7 shows a part of the tuyeres in FIG. 1 and more specifically the tuyeres No. 1 through No. 10 in the left end group and the tuyeres No. 44 through No. 48 in the right end group. In the conventional mechanical puncher, four punching rods are driven by one cylinder. In contrast, in the mechanical puncher of the invention, two punching rod sets are provided. In each set, two punching rods are driven by one cylinder thereby to improve the flexibility in punching operation.

It is assumed that the tuyeres are punched by the two punching rod sets, that is, four punching rods beginning with tuyere No. 1. The start of the punching of the tuyeres can be commenced by detecting a reduction in the amount of air blown through the converter. By way of example, the operation will be described with reference to the case where solidified encrustations are formed in tuyere No. 8 to the extent that they cannot be removed by the punching force of the cylinder. Solidified encrustations in the forty-eight tuyeres should be removed by repeating the punching operation twelve times (12×4 punching rods=48). For this discussion, it is assumed that the tuyere No. 7 remains unpunched because it has been impossible to punch tuyere No. 8.

Before the mechanical puncher returns, the position of the mechanical puncher is shifted by one tuyere so that the punching operation is started with tuyeres No. 47 through No 44. Although the other tuyeres may be successively punched, the tuyere No. 9 remains unpunched because it has been impossible to punch tuyere No. 8 as described above. Accordingly, after the punching operation has otherwise been completed, the tuyeres No. 48 and No. 9 have not punched. The solidified encrustations in the tuyere No. 8 should be removed by other means. The abovedescribed series of operations are carried out in response to instruction signals from the control device.

Figure 9A:
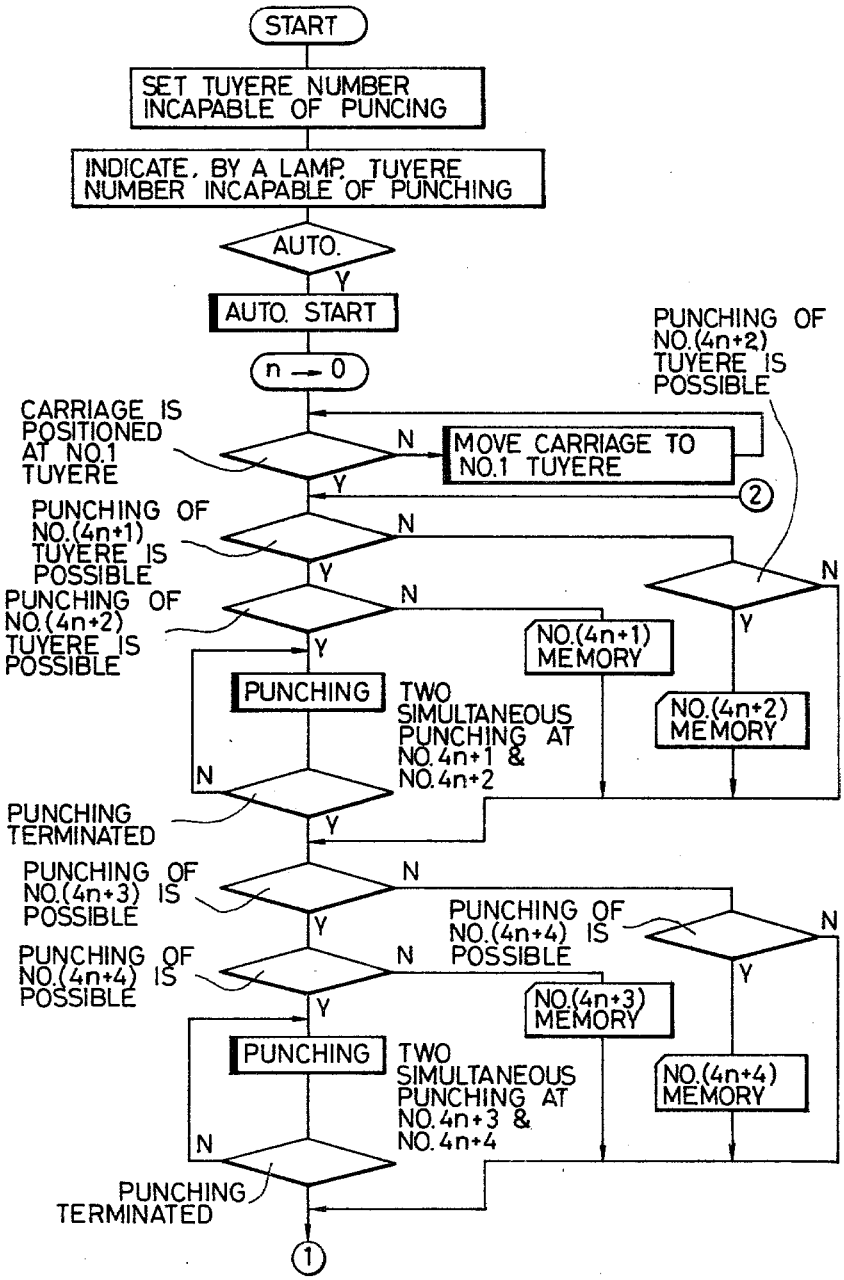
FIGS. 9A–9C taken together are a flow chart describing the operations of a digital processor used with the invention.
Figure 9B:
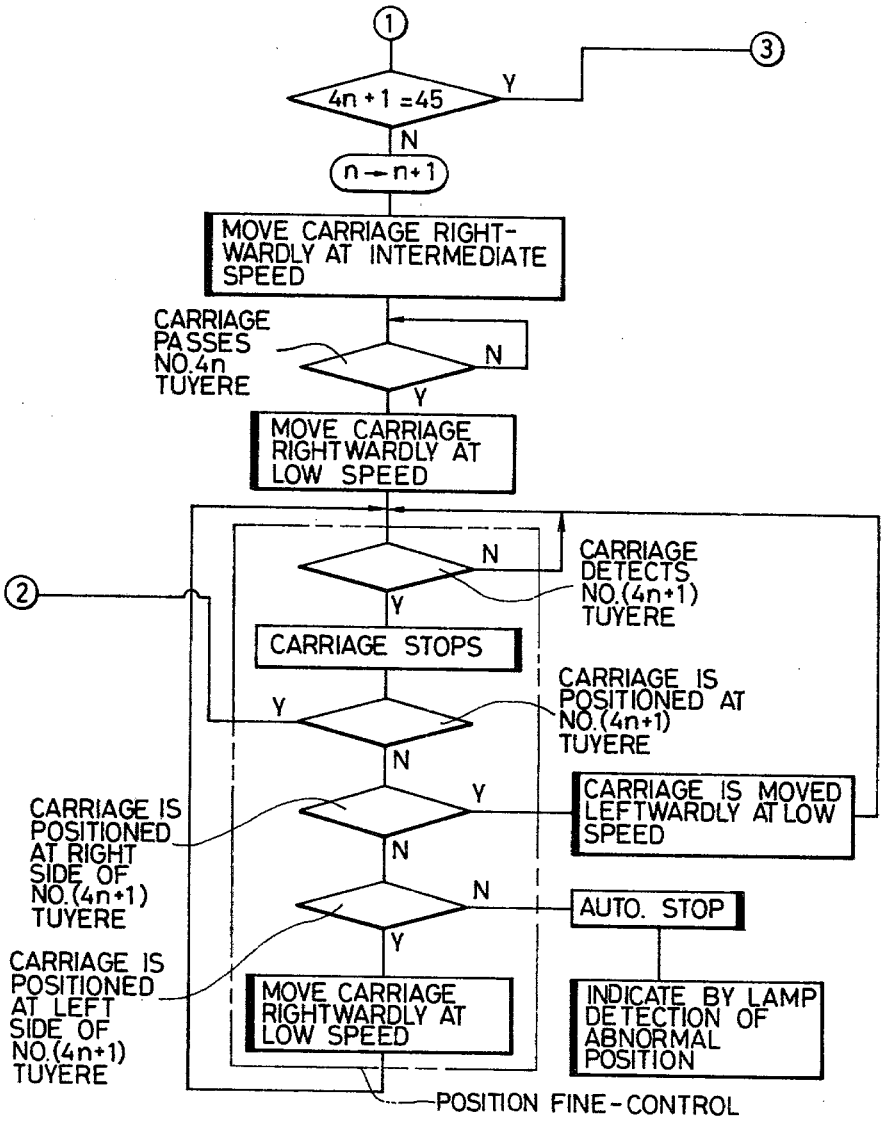
Figure 9C:
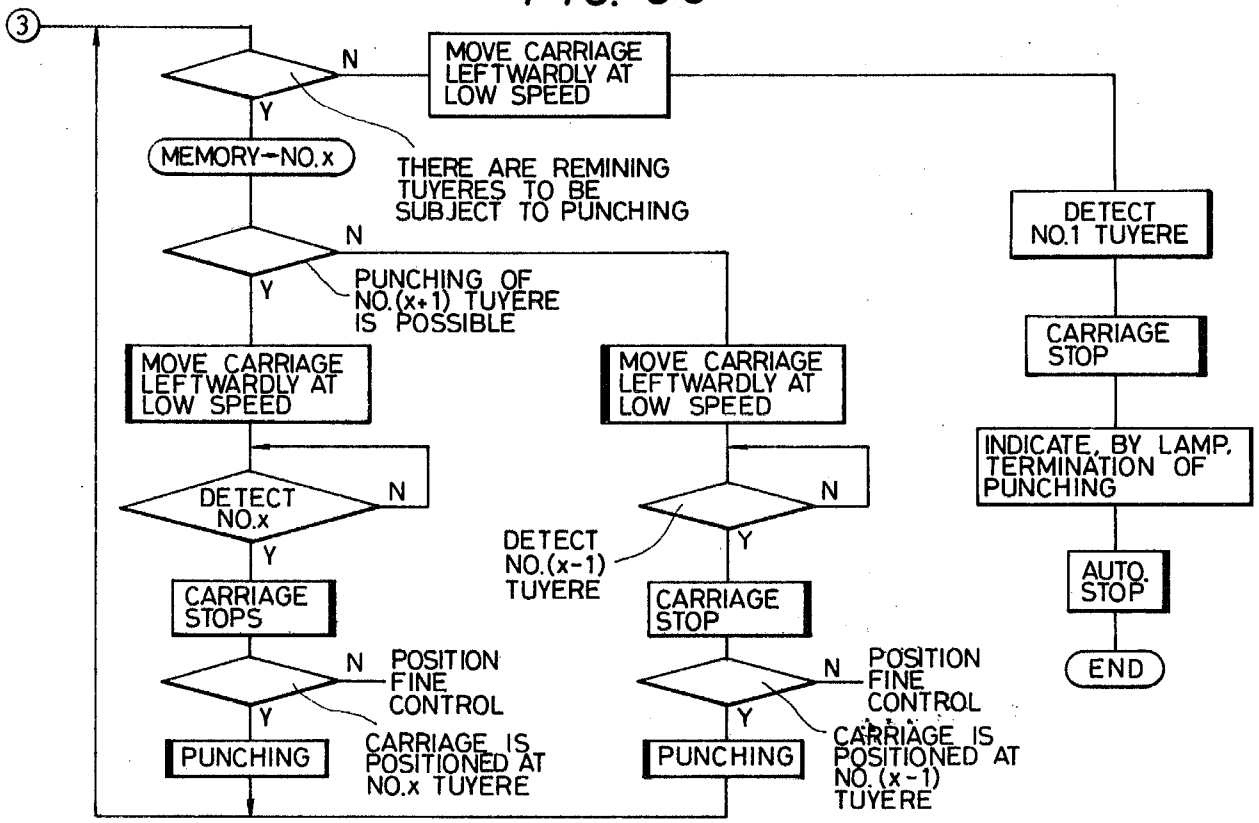

The control of the positioning of the carriage and mechanical puncher is accomplished by a control device constituted by a digital processor system. In this system, the output signals from the light receiving units, speed detector and punching rod position detector are assembled using standard data assembly techniques and coupled to data inputs of a digital processor. The digital processor then operates to produce the necessary control signals to move the carriage to the appropriate positions. The operation of the digital processor is in accordance with the flow diagrams of FIGS. 9A–9C.

According to the invention, to selectively punch the tuyeres, the punching rod can be correctly set to punch the selected tuyeres and the selected tuyeres punched completely automatically. To successively punch the tuyeres, the number of the tuyere the punching of which has been impossible can be displayed by employing a method in which, when it is impossible to insert the punching rod thoroughly into the tuyere, the reaction force occurring in the rear end of the punching rod is detected and converted into an electrical signal and the tuyeres except those the punching of which has been found to be impossible are sequentially and automatically punched.

As the punching operation can be started upon detection of a reduction of the amount of air blown through the converter, the punching operation of the tuyeres of the converter can be completely automatically accomplished. Thus, the invention contributes significantly to safety and to a reduction in the number of operators and accordingly to a reduction in personnel expenses. Furthermore, according to the invention, the position of a tuyere can be readily and positively detected.

What is claimed is:

1. A method for punching the tuyeres of a converter having a longitudinal axis with the punching rods of a mechanical puncher mounted on a carriage running on rails including detectable elements provided respectively for said tuyeres of said converter and provided adjacent said tuyeres of said converter, and non-contacting type detector means mounted on said carriage comprising the steps of:

(a) setting a vertical position and orientation of said punching rods of said mechanical puncher so as to render said punching rods parallel to the axes of said tuyeres;

(b) providing a signal to move said carriage on said rails in a direction parallel to said axis of said converter;

(c) processing output signals from said non-contacting type position detector means by control means to determine a position of said carriage wherein the punching rods of said mechanical puncher are aligned with respective aimed tuyeres;

(d) providing a signal to stop said carriage in the said position;

(e) providing an instruction signal to said mechanical puncher to punch said aimed tuyeres, and (f) acknowledging termination of said punching operation to move said carriage so as to shift said punching rods into alignment with next aimed tuyeres, whereby said tuyeres are selectively and successively punched, wherein said detectable elements comprise light intercepting plates each of which has at least one light transmission hole respresentative of the number of a corresponding tuyere, at least one light transmission hole for controlling the running speed of said carriage on the rails, and at least one light transmission hole for finely adjusting the position of said carriage, and wherein said non-contacting type detector means comprises a photoelectric tube device comprising light emitting units and light receiving units arranged to be positioned opposite one another on opposite sides of said light intercepting plates.

2. The method as claimed in claim 1 further comprising the step of, before said tuyeres of said converter are punched, adjusting the position of said mechanical puncher in conformance with the angle of inclination and vertical and horizontal displacement of said tuyeres of said converter.

3. The method as claimed in claim 1 wherein said mechanical puncher comprises two cylinders each of which drives two punching rods so as to enhance flexibility of punching of said tuyeres of said converter and further comprising the step of, if it is impossible to punch a tuyere with said mechanical puncher in the course of moving said mechanical puncher in one direction along said longitudinal axis, shifting the position of said mechanical puncher by one tuyere and punching said tuyeres again by moving said mechanical puncher in the opposite direction along said longitudinal axis.

4. The method as claimed in claim 1 wherein said mechanical puncher comprises an AC variable speed motor with a brake employed to drive said carriage of said mechanical puncher.

5. A device for controlling the position of a carriage of a mechanical puncher running on rails for punching the tuyeres of a converter comprising: a plurality of light intercepting plates, one of said light intercepting plates being provided for each of said tuyeres at a position adjacent the corresponding tuyere, each of said light intercepting plates having at least one light transmission hole representative of the number of the corresponding tuyere, at least one light transmission hole for controlling the running speed of the carriage, and at least one light transmission hole for finely adjusting the position of said carriage; a plurality of light emitting elements coupled to be moved with said carriage, said light emitting elements directing light towards said light intercepting plates; and a plurality of photoelectric detector means movable with said carriage and disposed upon a side of said light intercepting plates opposite said light emitting means.

* * * * *